US010992030B2

(12) United States Patent
Han et al.

(10) Patent No.: US 10,992,030 B2
(45) Date of Patent: Apr. 27, 2021

(54) ULTRA-WIDEBAND MIMO ANTENNA AND TERMINAL

(71) Applicant: AAC Technologies Pte. Ltd., Singapore (SG)

(72) Inventors: Hongjuan Han, Shenzhen (CN); Yuehua Yue, Shenzhen (CN); Jianchuan Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 38 days.

(21) Appl. No.: 16/524,081

(22) Filed: Jul. 28, 2019

(65) Prior Publication Data

US 2020/0044320 A1 Feb. 6, 2020

(30) Foreign Application Priority Data

Aug. 3, 2018 (CN) ..... 201810880154.2

(51) Int. Cl.

| | |
|---|---|
| ***H01Q 1/24*** | (2006.01) |
| ***H01Q 1/48*** | (2006.01) |
| ***H01Q 1/52*** | (2006.01) |
| ***H01Q 21/06*** | (2006.01) |

(52) U.S. Cl.

CPC ..... *H01Q 1/246* (2013.01); *H01Q 1/48* (2013.01); *H01Q 1/521* (2013.01); *H01Q 21/061* (2013.01)

(58) Field of Classification Search

CPC ..... H01Q 1/246; H01Q 1/48; H01Q 1/521; H01Q 21/061; H01Q 21/28; H01Q 1/36; H01Q 1/50

See application file for complete search history.

(56) References Cited

U.S. PATENT DOCUMENTS

| | | | | |
|---|---|---|---|---|
| 2017/0141473 | A1* | 5/2017 | Sharawi | H01Q 1/48 |
| 2017/0250471 | A1* | 8/2017 | Lee | H01Q 9/0407 |
| 2020/0044329 | A1* | 2/2020 | Wu | H01Q 1/521 |

FOREIGN PATENT DOCUMENTS

| | | | |
|---|---|---|---|
| CN | 104022354 | A1 | 9/2014 |
| CN | 104269617 | A1 | 1/2015 |

OTHER PUBLICATIONS

1st Office Action dated Nov. 19, 2019 by SIPO in related Chinese Patent Application No. 201810880154.2 (6 Pages).

* cited by examiner

*Primary Examiner* — Daniel D Chang
(74) *Attorney, Agent, or Firm* — W&G Law Group LLP

(57) ABSTRACT

The present disclosure provides an ultra-wideband multiple-input multiple-output (MIMO) antenna, including a printed circuit board (PCB) and four mirror-symmetrical antenna components having a same structure and disposed on the PCB. The PCB includes a system ground and a circuit region, and an orthographic projection of the antenna components on the PCB falls within the system ground. The radiation portion is disposed parallel to and separately from the PCB. The connection portion includes a first grounding pin, a second grounding pin, and an antenna feed point pin respectively extending from the radiation portion toward the PCB and disposed separately from each other, the first grounding pin and the second grounding pin are connected to the system ground, and the antenna feed point pin is connected to an external power supply. The present disclosure further provides a terminal. The ultra-wideband MIMO antenna and the terminal have good antenna performance.

5 Claims, 4 Drawing Sheets

ULTRA-WIDEBAND MIMO ANTENNA AND TERMINAL

TECHNICAL FIELD

The present disclosure relates to the field of wireless communications technologies, and in particular, to an ultra-wideband multiple-input multiple-output (MIMO) antenna and a terminal.

BACKGROUND

As the discussions on 5G standards proceed, 5G related bands have been basically determined. Ministry of Industry and Information Technology of the People's Republic of China has issued a notice on the use of bands of 3300 to 3600 MHz and 4800 to 5000 MHz in the 5G mobile communications systems. That is, the foregoing bands will be used as 5G sub 6 GHz bands in China.

5G ultra-dense networking is a main technical solution for satisfying the mobile data traffic requirements in 2020 and in the future. Typical application scenarios of ultra-dense networking include areas such as offices, stadiums, metros, and underground parking lots. 5G ultra-dense networking requires a significantly larger quantity of indoor small base stations. In addition, 5G communications systems have higher requirement on the data transmission rate. One way to increase the data transmission rate is to further increase the quantity of antennas included in a single base station at the base station side.

Multiple-input multiple-output (MIMO) technology is a core technology for 5G antennas. The difficulty in designing a MIMO antenna is how to integrate a plurality of antenna units in a limited space while obtaining a higher isolation. Currently existing ultra-wideband MIMO antennas mostly have a narrow bandwidth, a low isolation, and a relatively large size.

Therefore, it is necessary to provide a novel ultra-wideband MIMO antenna to solve the foregoing problems.

DETAILED DESCRIPTION

The technical solutions in the embodiments of the present disclosure are clearly and completely described with reference to the accompanying drawings in the embodiments of the present disclosure. Apparently, the described embodiments are merely some rather than all of the embodiments of the present disclosure.

Figure 1:
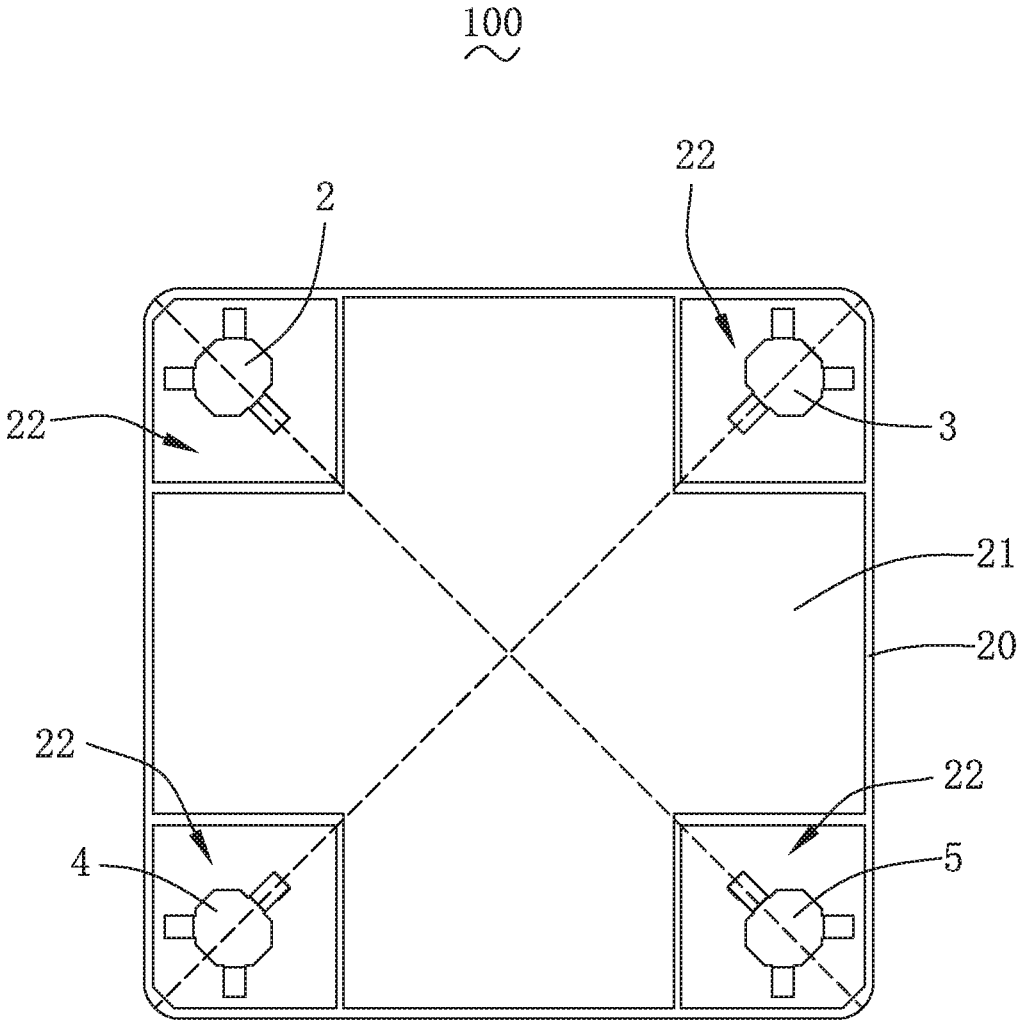
FIG. 1 is a schematic structural diagram of an ultra-wideband multiple-input multiple-output (MIMO) antenna according to the present disclosure.
Figure 2:
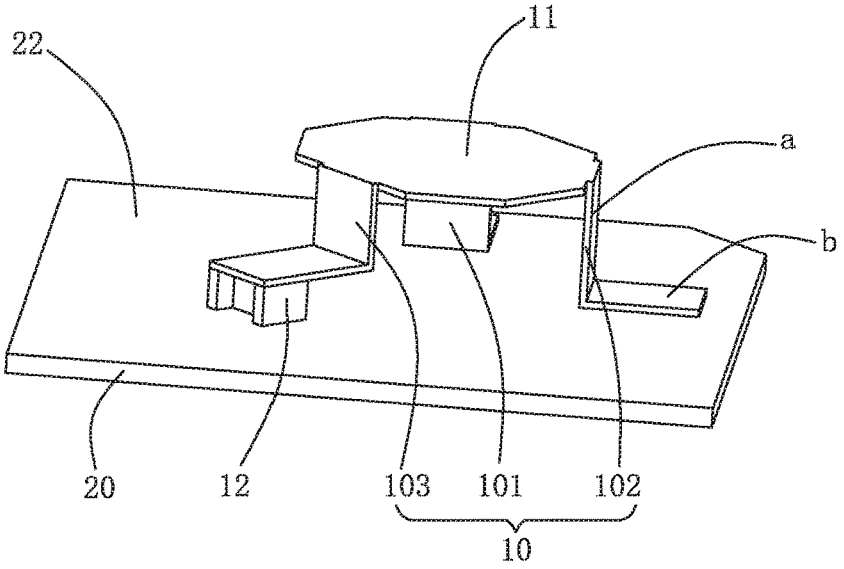
FIG. 2 is a schematic structural diagram of a single antenna component in the ultra-wideband MIMO antenna shown in FIG. 1.
Figure 3:
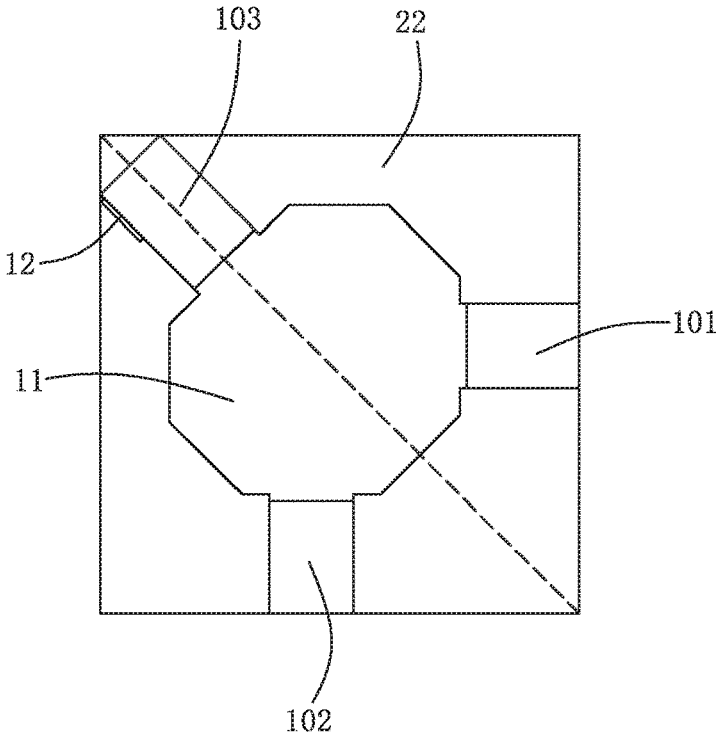
FIG. 3 is a schematic plan view of the single antenna component shown in FIG. 2.

As shown in FIG. 1 to FIG. 3, an embodiment of the present disclosure provides an ultra-wideband multiple-input multiple-output (MIMO) antenna 100. The ultra-wideband MIMO antenna 100 is applicable to a terminal such as a small base station. This is not limited in this disclosure.

Specifically, the ultra-wideband MIMO antenna 100 provided in the embodiment of the present disclosure includes a printed circuit board (PCB) 20 and four mirror-symmetrical antenna components 2 to 5 having a same structure and disposed on the PCB 20. The PCB 20 includes a system ground 22 and a circuit region 21. Generally, the system ground 22 is a metal layer laid on the PCB 20. The four antenna components 2 to 5 are disposed over the system ground 22 of the PCB 20, and orthographic projections of the four antenna components 2 to 5 on the PCB 20 fall within the system ground 22. The four antenna components 2 to 5 are located in a square area of the PCB 20, and the four antenna components 2 to 5 are located at four top corners of the square area.

Each of the antenna components includes a radiation portion 11 and a connection portion 10 configured to feed the radiation portion 11. The radiation portion 11 is disposed parallel to and separately from the PCB 20. A distance between the radiation portion 11 and the PCB 20 does not exceed 9.2 mm. Preferably, the radiation portion 11 is of a regular octagonal structure or a non-regular octagonal structure. When the shape of the radiation portion 11 is designed, the length of each side may be adjusted according to actual situations, so as to adjust a frequency offset and a voltage standing wave ratio of the antenna.

The connection portion 10 includes a first grounding pin 101, a second grounding pin 102, and an antenna feed point pin 103 respectively extending from a periphery of the radiation portion 11 toward the PCB 20 and disposed separately from each other, and the first grounding pin 101 and the second grounding pin 102 are connected to the system ground 22, the antenna feed point pin 103 is connected to an external power supply. The antenna component uses a one-feeder two-ground structure, to satisfy requirements on both the radio frequency performance and the mechanical strength of the antenna. Preferably, the first grounding pin 101 and the second grounding pin 102 of each antenna component are disposed symmetrically with respect to a diagonal of the square area, and the antenna feed point pin 103 is arranged on the diagonal of the square area. More preferably, an angle between the first grounding pin 101 and the second grounding pin 102 is 90°. Certainly, the positions of the first grounding pin 101, the second grounding pin 102, and the antenna feed point pin 103 may be adjusted according to specific situations, and are not limited to those shown in this embodiment.

In this embodiment, the first grounding pin 101, the second grounding pin 102, and the antenna feed point pin 103 are metal elastic pieces having an L-shape structure, and each include a vertical portion a perpendicular to the radiation portion 11 and a horizontal portion b connected to the vertical portion a, the horizontal portions of the first grounding pin 101 and the second grounding pin 102 are fixed to the system ground 22 by welding, and the horizontal portion of the antenna feed point pin 103 is parallel to and separate from the system ground 22 and is fixedly connected to the system ground 22 through a plastic supporting member 12, thereby further improving the structural stability.

The single antenna component occupies a relatively small space. To be specific, the single antenna component occupies a square area, generally of a size of 30 mm*30 mm. The space occupied by the single antenna component may be adjusted according to the size of a terminal using the ultra-wideband MIMO antenna.

Further, the radiation portion 11 and the connection portion 10 of the antenna component are integrally formed, thereby avoiding the unnecessary welding process and improving the antenna reliability. Preferably, the antenna component is formed by stamping or bending a copper alloy or another metal sheet, making it suitable for mass production.

In this embodiment, an operating band of the ultra-wideband MIMO antenna 100 includes 3300 to 5000 MHz, covering 5G sub 6 GHz bands in China, and a voltage standing wave ratio of the antenna is less than 1.5.

Figure 4:
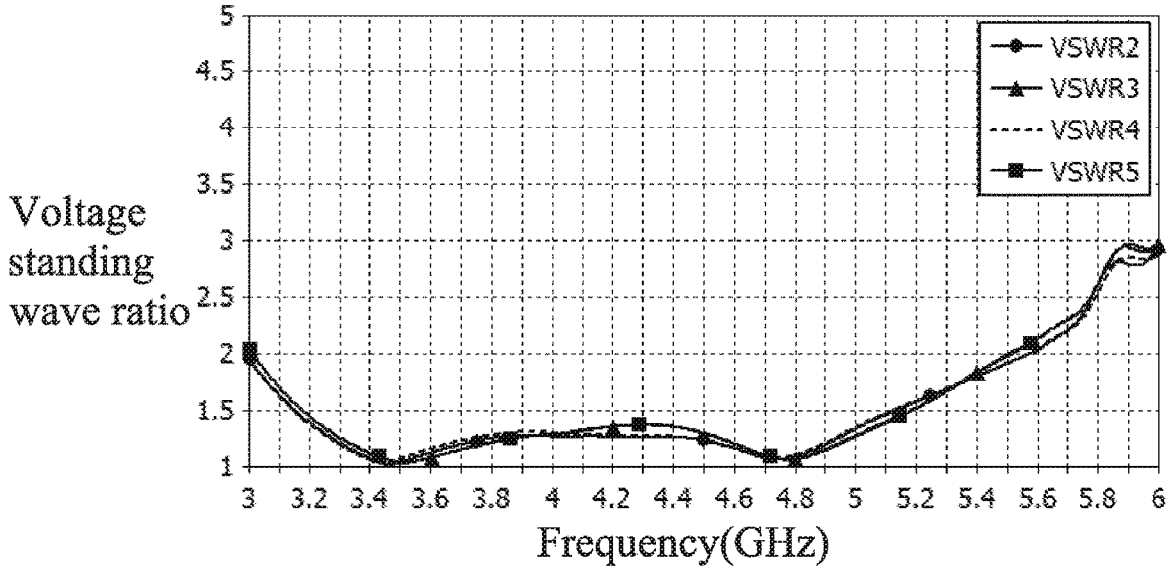
FIG. 4 is a simulation diagram showing a voltage standing wave ratio in an operating band of each antenna component in an ultra-wideband MIMO antenna according to the present disclosure.

FIG. 4 is a diagram showing a voltage standing wave ratio in an operating band of each antenna component in an ultra-wideband MIMO antenna according to the present disclosure. The result shows that for the antenna components 2 to 5, the voltage standing wave ratio is less than 1.5 within the entire operating band (3300 to 5000 MHz).

Figure 5:
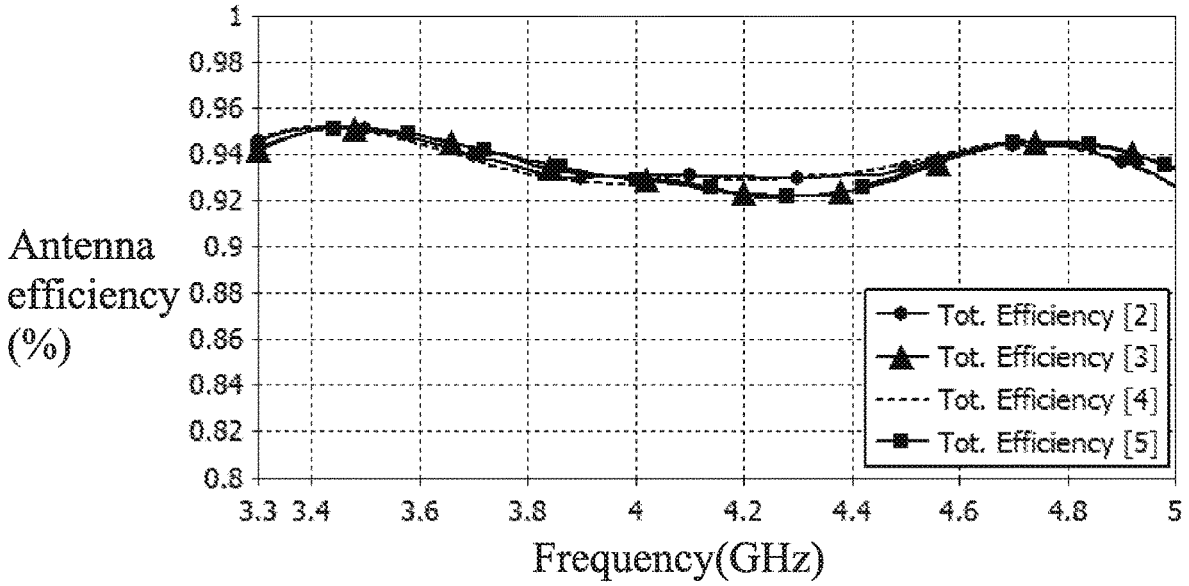
FIG. 5 is a simulation diagram showing antenna efficiency in an operating band of each antenna component in an ultra-wideband MIMO antenna according to the present disclosure.

FIG. 5 is a diagram showing antenna efficiency in an operating band of each antenna component in an ultra-wideband MIMO antenna according to the present disclosure. The result shows that for the antenna components 2 to 5, the antenna efficiency reaches at least 90% within the entire operating band (3300 to 5000 MHz), indicating that the ultra-wideband MIMO antenna has good antenna performance.

Figure 6:
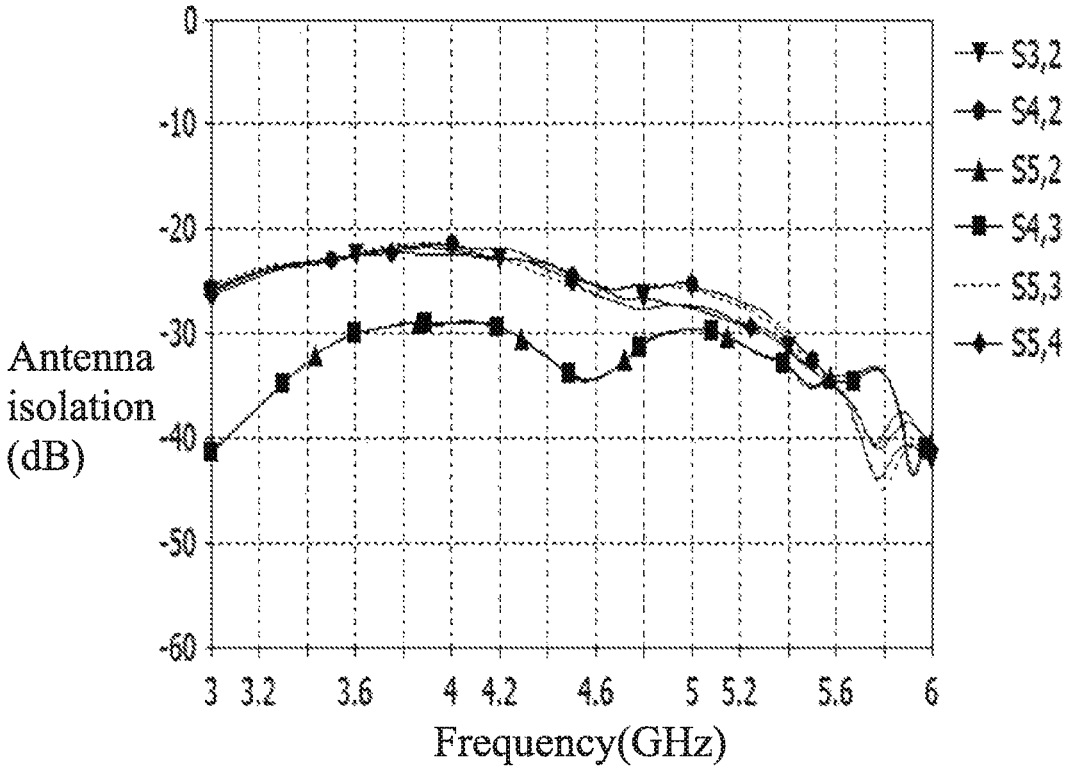
FIG. 6 is a simulation diagram showing an isolation in an operating band of each antenna component in an ultra-wideband MIMO antenna according to the present disclosure.

FIG. 6 is a diagram showing an isolation in an operating band of each antenna component in an ultra-wideband MIMO antenna according to the present disclosure. The result shows that for the antenna components 2 to 5, the isolation between any two of the antenna components is better than −20 dB within the entire operating band (3300 to 5000 MHz), indicating that good isolation performance is achieved between the antenna components in the ultra-wideband MIMO antenna.

The present disclosure further provides a terminal. The terminal includes the technical features of the ultra-wideband MIMO antenna described above. Certainly, the foregoing technical effects can also be achieved by using the ultra-wideband MIMO antenna.

Preferably, the terminal is a small base station including 4 transmitting antennas and 4 receiving antennas (4T4R).

Compared with the related art, the ultra-wideband MIMO antenna and the terminal provided in the present disclosure have the following beneficial effects:

1) The operating band of the ultra-wideband MIMO antenna includes 3300 to 5000 MHz, satisfying the requirements of 5G sub 6 GHz bands in China. Within the entire operating band, the voltage standing wave ratio (VSWR) of the antenna is less than 1.5, the antenna efficiency reaches at least 90%, and the isolation between neighboring antenna components is better than −20 dB. The antenna has a good ultra wideband, antenna performance, and isolation performance.

2) Single antenna components constituting the ultra-wideband MIMO antenna have a relatively small size, facilitating the antenna layout in a small base station, and enabling the small base station to include 4 transmitting antennas and 4 receiving antennas (4T4R).

3) The ultra-wideband MIMO antenna has a simple structure, and the single antenna components may be formed by stamping or bending a copper alloy or another metal sheet. Therefore, the antenna is simple to manufacture at low costs, and therefore is suitable for massive production.

The foregoing descriptions are merely embodiments of the present disclosure but are not intended to limit the patent scope of the present disclosure, an equivalent structure or equivalent procedure replacement made based on the content of the specification and the accompanying drawings of the present disclosure or those directly or indirectly applied the content of the specification and the accompanying drawings of the present disclosure to other relevant technical fields are included in the patent protection scope of the present disclosure.

What is claimed is:

1. An ultra-wideband multiple-input multiple-output (MIMO) antenna, comprising a printed circuit board (PCB) and four mirror-symmetrical antenna components having a same structure and disposed on the PCB, wherein each of the antenna components comprises a radiation portion of a non-hollowed monolithic plate structure and a connection portion configured to feed the radiation portion, the radiation portion and the connection portion are integrally formed by stamping or bending a copper alloy or another metal sheet;

the PCB comprises a system ground and a circuit region, and an orthographic projection of the antenna components on the PCB falls within the system ground;

the radiation portion is disposed parallel to and separately from the PCB;

the connection portion comprises a first grounding pin, a second grounding pin and an antenna feed point pin respectively extending from a periphery of the radiation portion toward the PCB and disposed separately from each other, the first grounding pin and the second grounding pin are connected to the system ground, and the antenna feed point pin is connected to an external power supply, the four antenna components are located in a square area, and the four antenna components are located at four top corners of the square area, the first grounding pin and the second grounding pin of each antenna component are disposed symmetrically with respect to a diagonal of the square area, and the antenna feed point pin is arranged on the diagonal of the square area.

2. The ultra-wideband MIMO antenna according to claim 1, wherein the first grounding pin, the second grounding pin, and the antenna feed point pin are metal elastic pieces having an L-shape structure, and each comprises a vertical portion perpendicular to the radiation portion and a horizontal portion connected to the vertical portion, and the horizontal portions of the first grounding pin and the second grounding pin are fixed to the system ground by welding, and the horizontal portions of the antenna feed point pin is parallel to and separate from the system ground and is fixedly connected to the system ground through a plastic supporting member.

3. The ultra-wideband MIMO antenna according to claim 1, wherein the radiation portion is of a regular octagonal structure or a non-regular octagonal structure.

4. The ultra-wideband MIMO antenna according to claim 1, wherein an operating band of the ultra-wideband MIMO antenna comprises 3300 to 5000 MHz.

5. A terminal, comprising an ultra-wideband MIMO antenna as described in claim 1.

* * * * *